US012410597B2

(12) United States Patent
Sun

(10) Patent No.: US 12,410,597 B2
(45) Date of Patent: Sep. 9, 2025

(54) DUAL-CONTROL FLUSHING DEVICE

(71) Applicant: Ningbo Mideay Electrical Appliance Co., Ltd., Cixi (CN)

(72) Inventor: Liyun Sun, Cixi (CN)

( * ) Notice: Subject to any disclaimer, the term of this patent is extended or adjusted under 35 U.S.C. 154(b) by 115 days.

(21) Appl. No.: 18/544,355

(22) Filed: Dec. 18, 2023

(65) Prior Publication Data

US 2024/0117617 A1 Apr. 11, 2024

Related U.S. Application Data

(63) Continuation of application No. PCT/CN2022/137830, filed on Dec. 9, 2022.

(51) Int. Cl.
*E03D 5/08* (2006.01)
*E03D 3/02* (2006.01)
*E03D 5/094* (2006.01)

(52) U.S. Cl.
CPC ..... *E03D 5/08* (2013.01); *E03D 5/094* (2013.01); *E03D 3/02* (2013.01)

(58) Field of Classification Search
CPC .. E03D 5/08; E03D 5/09; E03D 5/092; E03D 5/094; E03D 3/12
See application file for complete search history.

(56) References Cited

U.S. PATENT DOCUMENTS 6,968,579 B1 * 11/2005 Feinberg ..... E03D 5/08 4/246.1
7,003,815 B2 * 2/2006 Herbst ..... E03D 5/08 4/246.1
11,391,391 B2 * 7/2022 Le ..... F16K 3/0254
2006/0075545 A1 * 4/2006 Herbst ..... E03D 5/08 4/249

* cited by examiner

*Primary Examiner* — Janie M Loeppke
(74) *Attorney, Agent, or Firm* — Addison D. Ault; IPGentleman Intellectual Property Services, LLC

(57) ABSTRACT

Provided is a dual-control flushing device, including: a body including a water tank; a valve assembly including a valve body and a valve stem configured to control opening or closing of a flushing port, wherein a transmission part extends from an end of the valve stem; a first flushing mechanism including a pressing assembly and a transmission assembly; a second flushing mechanism including a foot-controlled assembly, a lifting block and a traction rope, wherein the lifting block includes a lifting part, the traction rope includes a first control end connected to the foot-controlled assembly and a second control end connected to the lifting block, the foot-controlled assembly is configured to squeeze or release the first control end, so that the first control end and the second control end move and drive the lifting block and the valve stem to lift synchronously. The dual-control flushing device is convenient for users.

9 Claims, 18 Drawing Sheets

DUAL-CONTROL FLUSHING DEVICE

CROSS-REFERENCE TO RELATED APPLICATION

This application is continuation of International Application No. PCT/CN2022/137830, filed on Dec. 9, 2022, entitled "Dual-Control Flushing Device", which claims priority to Chinese Application No. 202222676439.9, filed on Oct. 10, 2022, incorporated herein by reference in their entirety.

TECHNICAL FIELD

The present disclosure relates to the field of sanitary appliances, and in particular to a dual-control flushing device.

BACKGROUND

At present, traditional toilet flushing devices usually have a button on the water tank to control flushing, that is a manual control way. This causes the water tank button to easily germinate bacterium, and requires the user to bend down to operate, which brings inconvenience to flushing the toilet.

There is a toilet flushing device in the prior art, which has an automatic flushing function. Generally, a sensor, such as an infrared sensor, is provided at a designated position of the toilet body. When it is sensed by the infrared sensor that the user has left, the flushing device is controlled to work by a signal, to open the valve for flushing. There is no need to start flushing with hands, and it is easy to use. However, due to the setting of the sensor, this type of flushing device inevitably requires additional connection to a power supply and an electric control device. A power outlet is required near the toilet, it is difficult to ensure the normal operation of the electronic control device after long-term use, and the cost of this type of flushing device is high, which is not conducive to its application in public toilets.

For another toilet flushing device in the prior art, it adds a foot-controlled flushing method to the above-mentioned automatic flushing device. The traditional push-button flushing device includes a valve body and a valve stem located in the valve body, the valve stem is provided in the middle of the valve body, and the opening of the valve body is controlled by the button. In order to form a transmission connection between the transmission component of the foot-controlled structure and the valve stem in the middle, it needs to remove the traditional button-type flushing device, change the traditional valve body structure, causing a waste of research, development and manufacturing costs, and causing the flushing device to be unable to function normally when power is lost.

SUMMARY

In view of the shortcomings of the existing technology, the present disclosure is intended to provide a dual-control flushing mechanism/device that is convenient for users to use.

The above technical objectives of the present disclosure are achieved through the following technical solutions:

A dual-control flushing device, comprising:

a body, provided with a water tank therein, wherein a flushing port is connected to the water tank;

a valve assembly provided in the water tank and comprising a valve body and a valve stem provided in the valve body, wherein the valve stem is configured for controlling opening or closing of the flushing port, a transmission part extends from an end of the valve stem;

a first flushing mechanism comprising a pressing assembly and a transmission assembly placed in the valve body, wherein the transmission assembly comprises a first transmission end coupled with the pressing assembly and a second transmission end coupled with the transmission part, a hinge part is provided between the first transmission end and the second transmission end, the second transmission end moves and drives the valve stem to lift as the pressing assembly is pressed;

a second flushing mechanism comprising a foot-controlled assembly, a lifting block and a traction rope placed outside the valve body, wherein the lifting block comprises a lifting part extending into the valve body, the lifting part holds a bottom of the transmission part, the traction rope comprises a first control end connected to the foot-controlled assembly and a second control end connected to the lifting block, the foot-controlled assembly is configured to squeeze or release the first control end, so that the first control end and the second control end move and drive the lifting block and the valve stem to lift synchronously.

According to some embodiments of the present disclosure, the foot-controlled assembly comprises an installation part placed in the body and a foot-controlled part extending out of the body;

the traction rope comprises a casing and a pull wire located in the casing, one end of the casing is fixed to the valve body, the first control end is formed on the other end of the casing and connected to the foot-controlled part, one end of the pull wire is fixed to the installation part, and the second control end is formed on the other end of the pull wire and connected to the lifting block.

According to some embodiments of the present disclosure, the traction rope comprises a stretching section arranged between the body and the water tank, and a lifting section arranged in the water tank, the stretching section and the lifting section are both arranged in a curved manner, the first control end is formed on the stretching section, the second control end is formed on the lifting section, the stretching section is squeezed through the first control end and at least partially enters the lifting section to force the lifting section to lift and drive the second control end to lift.

According to some embodiments of the present disclosure, a first movable section is formed between the first control end and a fixed end of the pull wire, a second movable section is formed between the second control end and a fixed end of the casing, and the first movable section and the second movable section are arranged in reverse.

According to some embodiments of the present disclosure, the lifting block is provided with a cavity for limiting a current position of the pull wire, at least one limiting clamp is provided in the cavity, the pull wire is clamped in the limiting clamp, and the pull wire is adjustably provided inside the cavity.

According to some embodiments of the present disclosure, the lifting block comprises a first housing and a second housing interlocked with each other, the cavity is further provided therein with a limiting rib corresponding to the limiting clamp.

According to some embodiments of the present disclosure, the transmission assembly comprises a first connecting rod rotatably arranged on an upper part of the valve body and a second connecting rod rotatably connected to the first connecting rod, the first transmission end is formed at an end of the first connecting rod and connected to the pressing assembly, the second transmission end is formed at a lower end of the second connecting rod and connected to the transmission part.

According to some embodiments of the present disclosure, the foot-controlled assembly comprises an installation part placed in the body and a foot-controlled part extending out of the body;

the foot-controlled part is configured to be capable of translating for a certain distance horizontally or approximately horizontally relative to the installation part; or the foot-controlled part is configured to be capable of rotating for an angle relative to the installation part; or the foot-controlled part is configured to be capable of translating for a certain distance vertically or approximately vertically relative to the installation part.

According to some embodiments of the present disclosure, a sealing assembly is provided between the water tank and the traction rope, and the sealing assembly comprises:

a first connecting piece, a first sealing piece being provided between the first connecting piece and the water tank, and a second sealing piece being provided between the first connecting piece and the casing;

a second connecting piece screwed on one end of the first connecting piece and configured to tightly pull the first connecting piece, so that the first sealing piece fits tightly between the first connecting piece and the water tank;

a third connecting piece screwed on the other end of the first connecting piece and configured to press the second sealing piece between the first connecting piece and the casing.

According to some embodiments of the present disclosure, the installation part is provided with a mounting bracket inserted into the body, a torsion spring is provided on the mounting bracket, the torsion spring enters the body with the mounting bracket and restricts the installation part from coming out.

Compared with the existing technology, the present disclosure has the following advantages and beneficial effects:

I. The second flushing mechanism in the present disclosure can be installed in the water tank of the toilet and located outside the valve body. It only needs to provide a guiding groove in the valve body for the lifting block to slide on it, and there is no need to change the structure of the valve body, so that it can be easily applied to the valve body of the traditional flushing device. Moreover, the first transmission end of the first flushing mechanism is engaged with the valve stem, the lifting part of the second flushing mechanism holds (is connected to) the bottom of the valve stem. When using the second flushing mechanism, the valve stem is lifted by the lifting block to achieve flushing. At this time, the first transmission end is lifted synchronously, and the second transmission end is able to avoid the pressing assembly through the hinge part, so that the first flushing mechanism and the second flushing mechanism have no interference therebetween. It not only retains the manual button flushing function of the traditional toilet, but also can flush through the foot-controlled part of the second flushing mechanism. The user does not need to manually press the flushing pressing button on the toilet, it can automatically flush the toilet and avoid bacterial cross-infection;

II. Both the first flushing mechanism and the second flushing mechanism provided by the present disclosure adopt a mechanical structure. There is no need for a built-in electronic control unit and no need to connect to an external power supply. The operation is stable and reliable, it can effectively reduce costs, and it is good for long-term use. By placing the installation part of the foot-controlled assembly in the body, and placing the operated foot-controlled part outside the body, the space for the foot-controlled flushing device is optimized, so as to facilitate area planning in different scenarios;

III. The traction rope is composed of a casing and a pull wire. The foot-controlled assembly squeezes the first control end on the casing, forces the part of the traction rope in the body to have a tendency to straighten, and part of the traction rope is squeezed into the water tank, and the part of the traction rope in the water tank is forced to grow and lift relatively, thereby driving the second control end to lift, that is, the first control end and the second control end travel relative to each other to realize the lifting of the valve stem, thereby opening the flushing port.

Figure 1:
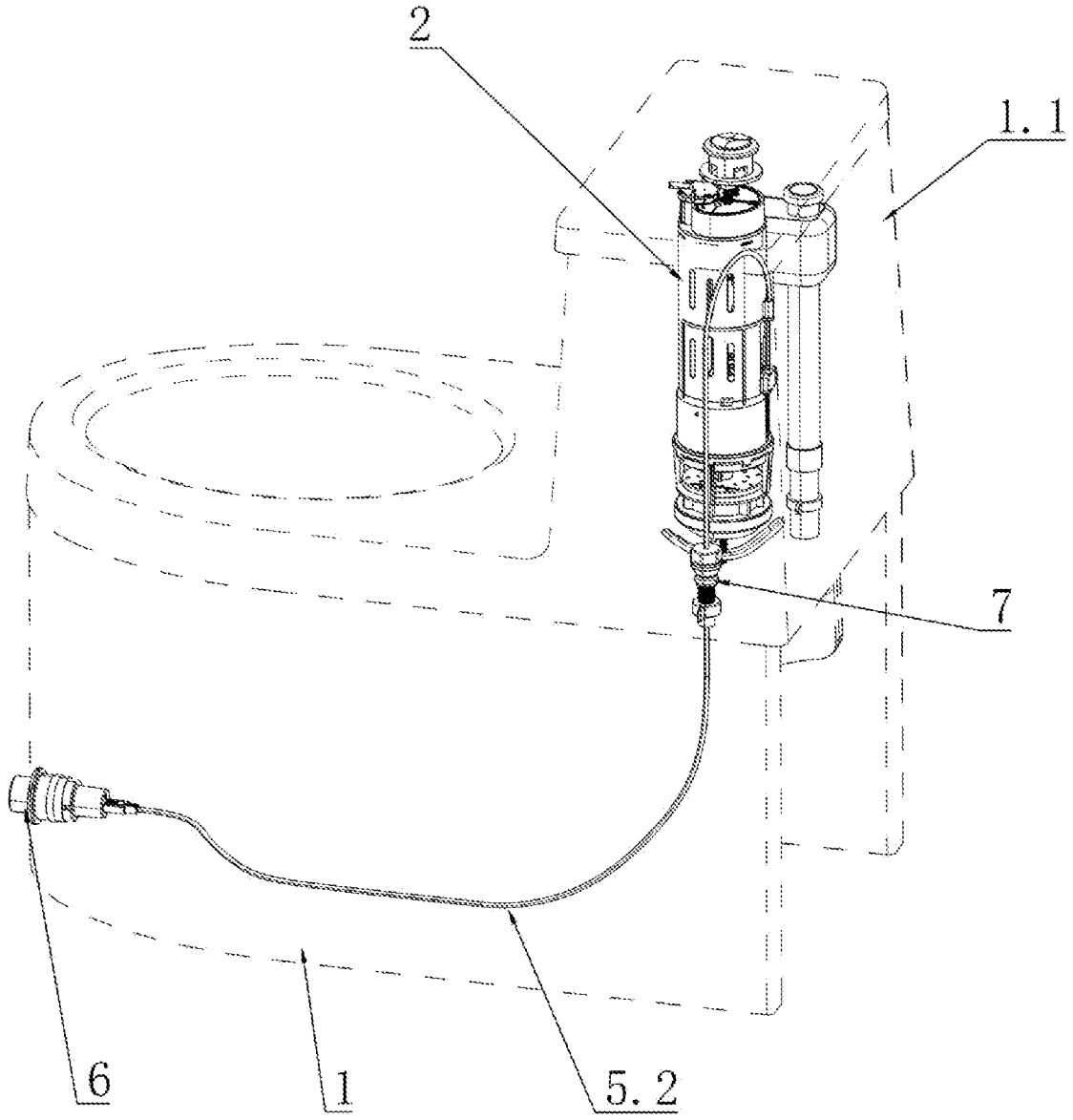
FIG. 1 is a schematic view of the main structure of the present disclosure.

In the drawings: 1, Body; 1.1, Water tank; 2, Valve assembly; 2.1, Valve body; 2.11, Guiding groove; 2.12, Installation slot; 2.2, Valve stem; 2.21, Transmission part; 2.22, First avoidance position; 3. First flushing mechanism; 3.1, Pressing assembly; 4. Transmission assembly; 4.1, First transmission end; 4.2, Second transmission end; 4.3, First connecting rod; 4.4, Second connecting rod; 4.5, First hinge part; 4.6, Second hinge part; 4.7, Protrusion; 5, Second flushing mechanism; 5.1, Lifting block; 5.11, Lifting part; 5.12, Cavity; 5.121, Petal-shaped body; 5.122, First channel; 5.123, Second channel; 5.124, Third channel; 5.125, Entrance section; 5.126, Exit section; 5.13, First housing; 5.14, Second housing; 5.15, Limiting rib; 5.16, Second avoidance position; 5.17, Limiting clamp; 5.2, Traction rope; 5.21, Casing; 5.22, Pull wire; 5.23, Stretching section; 5.24, Lifting section; 5.25, Casing fixed end; 5.26, Pull wire fixed end; 5.3, First control end; 5.4, Second control end; 5.41, Fixed end; 5.5, First movable section; 5.6, Second movable section; 5.7, Tension spring; 6, Foot-controlled assembly; 6.1, Installation part; 6.11, Movement cavity; 6.12, Slideway; 6.13, Installation ring; 6.14, Rotation cavity; 6.15, Channel; 6.2, Foot-controlled part; 6.21, Hook; 6.22, First shaft body; 6.23, Foot pedal; 6.24, Transmission plate; 6.25, Second shaft body; 6.26, Plug-in assembly; 7, Sealing assembly; 7.1, First connecting piece; 7.2, Second connecting piece; 7.3, Third connecting piece; 8, First sealing piece; 8.1, Sealing ring-shaped protrusion; 8.2, Cone; 9, Second sealing piece; 10, Second spring; 11, Sealing sleeve; 11.1, Sealing edge; 11.2, annular protrusion.

DETAILED DESCRIPTION OF EMBODIMENTS

The technical solutions in the embodiments of the present disclosure will be clearly and completely described below with reference to the accompanying drawings in the embodiments of the present disclosure. Obviously, the described embodiments are only part of the embodiments of the present disclosure, rather than all the embodiments. Based on the embodiments of the present disclosure, all other embodiments obtained by those of ordinary skill in the art without creative efforts fall within the scope of protection of the present disclosure.

It should be understood that although the terms, such as upper, middle, lower, top, and end, are used herein to describe various elements, these elements are not limited by these terms. These terms are used only to distinguish elements from each other for ease of understanding but are not intended to define any directional or sequential limitations.

As shown in FIGS. 1-15, a dual-control flushing device includes:

- a body 1, connected to a water tank 1.1, wherein the water tank 1.1 is provided with a valve assembly 2 therein, and a flushing port is provided between the water tank 1.1 and the body 1;
- a valve assembly 2 including a valve body 2.1 and a valve stem 2.2 located in the valve body 2.1, wherein the valve stem 2.2 is configured to move relative to the flushing port to control the opening or closing of the flushing port, a transmission part 2.21 extends from an end of the valve stem 2.2;
- a first flushing mechanism 3 including a pressing assembly 3.1 and a transmission assembly 4 placed in the valve body 2.1, wherein the transmission assembly 4 includes a first transmission end 4.1 coupled with the pressing assembly 3.1 and a second transmission end 4.2 coupled with the transmission part 2.21, a hinge part is provided between the first transmission end 4.1 and the second transmission end 4.2, by pressing the pressing assembly 3.1, the first transmission end 4.1 drives the second transmission end 4.2 to lift through the hinge part, so that the valve stem 2.2 lifts and leaves the flushing port, thereby opening the flushing port;
- a second flushing mechanism 5 including a foot-controlled assembly 6, a lifting block 5.1 and a traction rope 5.2 placed outside the valve body 2.1, wherein the lifting block 5.1 includes a lifting part 5.11 extending into the valve body 2.1, the lifting part 5.11 holds a bottom of the transmission part 2.21, the traction rope 5.2 includes a first control end 5.3 connected to the foot-controlled assembly 6 and a second control end 5.4 connected to the lifting block 5.1, the foot-controlled assembly 6 is configured to squeeze or release the first control end 5.3, so that the first control end 5.3 and the second control end 5.4 move and drive the lifting block 5.1 and the valve stem 2.2 to lift synchronously, by the action of the foot-controlled assembly 6 and squeezing the first control end 5.3, the second control end 5.4 is forced to move upward relatively, and the second control end 5.4 drives the valve stem 2.2 away from the flushing port through the lifting block 5.1, thereby opening the flushing port.

Specifically, the valve body 2.1 is provided with a guiding groove 2.11 in which the lifting block 5.1 slides.

By using the first flushing mechanism 3 and the second flushing mechanism 5 in this embodiment, the traditional structure of valve body 2.1 can be used. The first flushing mechanism 3 is arranged in the middle of the valve body 2.1, and the second flushing mechanism 5 is arranged outside the valve body 2.1, it is only necessary to provide an additional guiding groove 2.11 in the valve body 2.1 for the lifting block 5.1 to slide in it. Mechanical dual-control water discharge can be realized without the need for an electronic control unit and a power supply.

Figure 4:
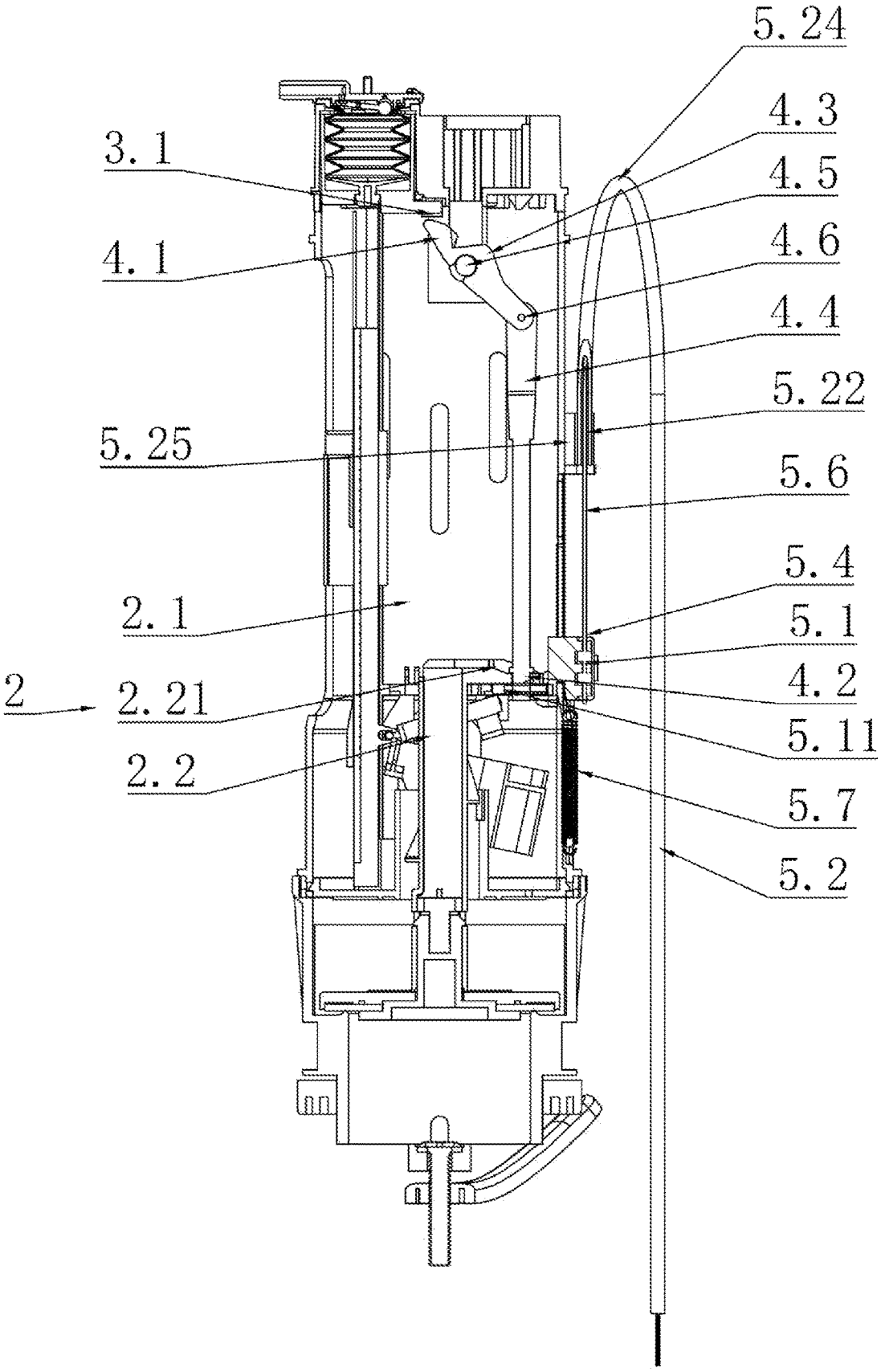
FIG. 4 is a schematic structural view of the valve assembly of the present disclosure in a closed state.
Figure 5:
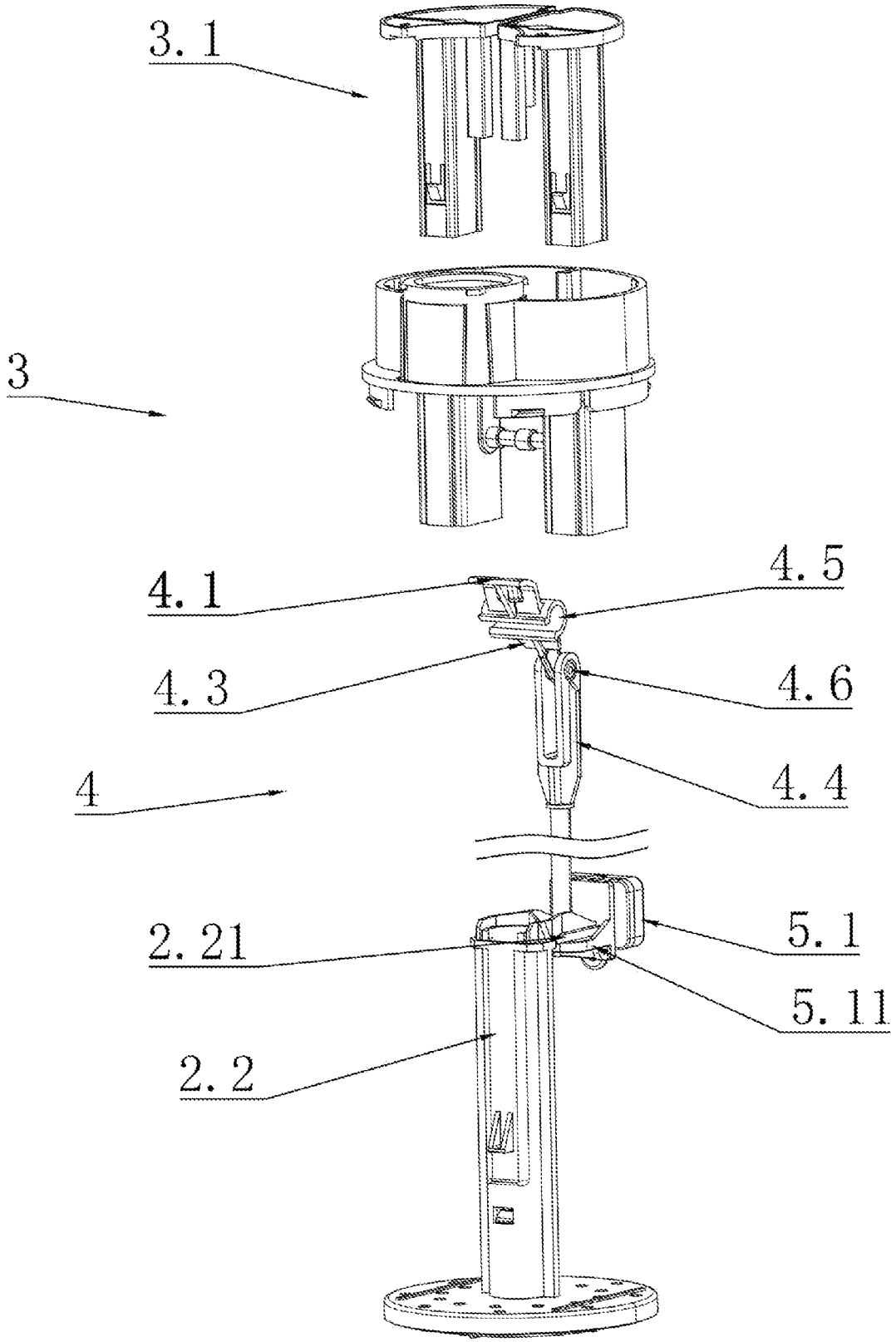
FIG. 5 is an exploded schematic view of the first flushing mechanism of the present disclosure.
Figure 6:
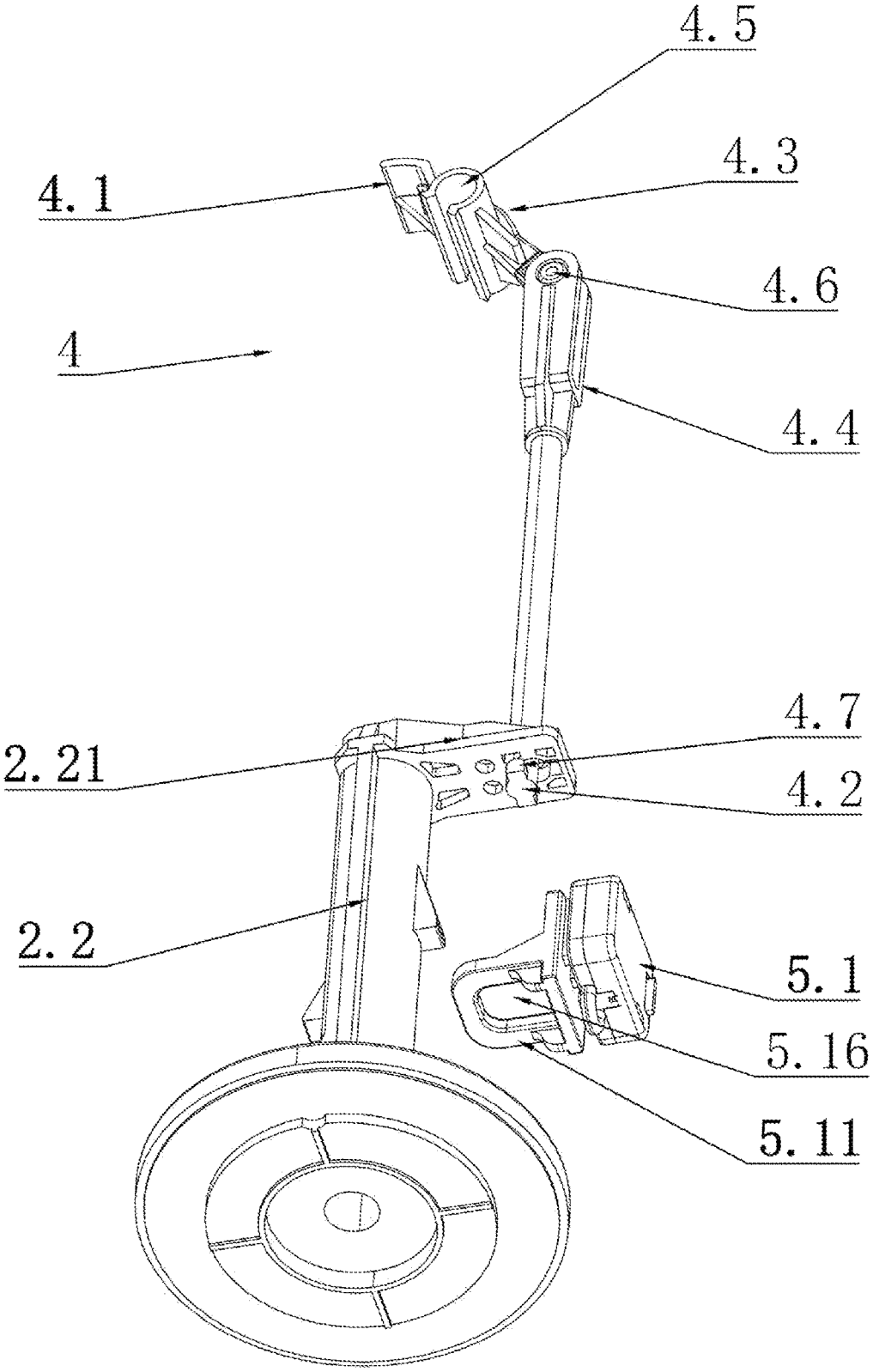
FIG. 6 is an exploded schematic view of the transmission assembly and lifting block of the present disclosure.

As shown in FIGS. 4 and 5, as a further implementation of the first flushing mechanism 3, the valve assembly 2 further includes a valve cover located on the top of the valve body 2.1, wherein the number of the pressing assemblies 3.1 is two, and they correspond to the control of different amounts of water output, respectively.

The transmission assembly 4 includes a first connecting rod 4.3 hinged at the lower part of the valve cover, and a second connecting rod 4.4 rotatably connected to the first connecting rod 4.3. The second connecting rod 4.4 is connected to the transmission part 2.21, a first hinge part 4.5 is formed between the first connecting rod 4.3 and the valve cover, and a second hinge part 4.6 is formed between the first connecting rod 4.3 and the second connecting rod 4.4, and the first transmission end 4.1 is formed at the end of the first connecting rod 4.3 and connected with any pressing assembly 3.1 to interact with the pressing assembly 3.1. The second transmission end 4.2 is formed at the lower end of the second connecting rod 4.4 and connected to the transmission part 2.21.

As a further implementation of the second transmission end 4.2, the transmission part 2.21 extends in the radial direction at the top of the valve stem 2.2, and is provided with a first avoidance position 2.22 in the middle of the transmission part 2.21, and protrusions 4.7 are provided on both sides of the second connecting rod 4.4, the second connecting rod 4.4 is inserted into the first avoidance position 2.22, and the protrusions 4.7 support the bottom of the transmission part 2.21.

Specifically, the lifting part 5.11 is arranged on the circumferential side of the first avoidance position 2.22, thereby being connected to the bottom of the transmission part 2.21, and forming a second avoidance position 5.16 in the middle for the bottom of the second connecting rod 4.4 to pass.

The working principle of the first flushing mechanism 3: the pressing assembly 3.1 is pressed, the driving end of the first connecting rod 4.3 moves downward, so that the other end of the first connecting rod 4.3 drives the second connecting rod 4.4 to lift, the protrusions 4.7 on the second connecting rod 4.4 drive the transmission part 2.21 and the valve stem 2.2 to lift, thereby opening the flushing port. During this process, the protrusions 4.7 on the second connecting rod 4.4 pass through the second avoidance position 5.16 and have no interference with the lifting part 5.11.

As a further embodiment of the foot-controlled assembly 6, the foot-controlled assembly 6 includes an installation part 6.1 placed inside the body 1, and a foot-controlled part 6.2 extending outside the body 1. The foot-controlled part 6.2 is used to be interacted with, to move for a distance, the first control end 5.3 is connected to the foot-controlled part 6.2. There is a sealing assembly 7 provided between the water tank 1.1 and the body 1, the traction rope 5.2 passes through the sealing assembly 7 and connected to the foot-controlled assembly 6 and the valve stem 2.2.

Figure 15:
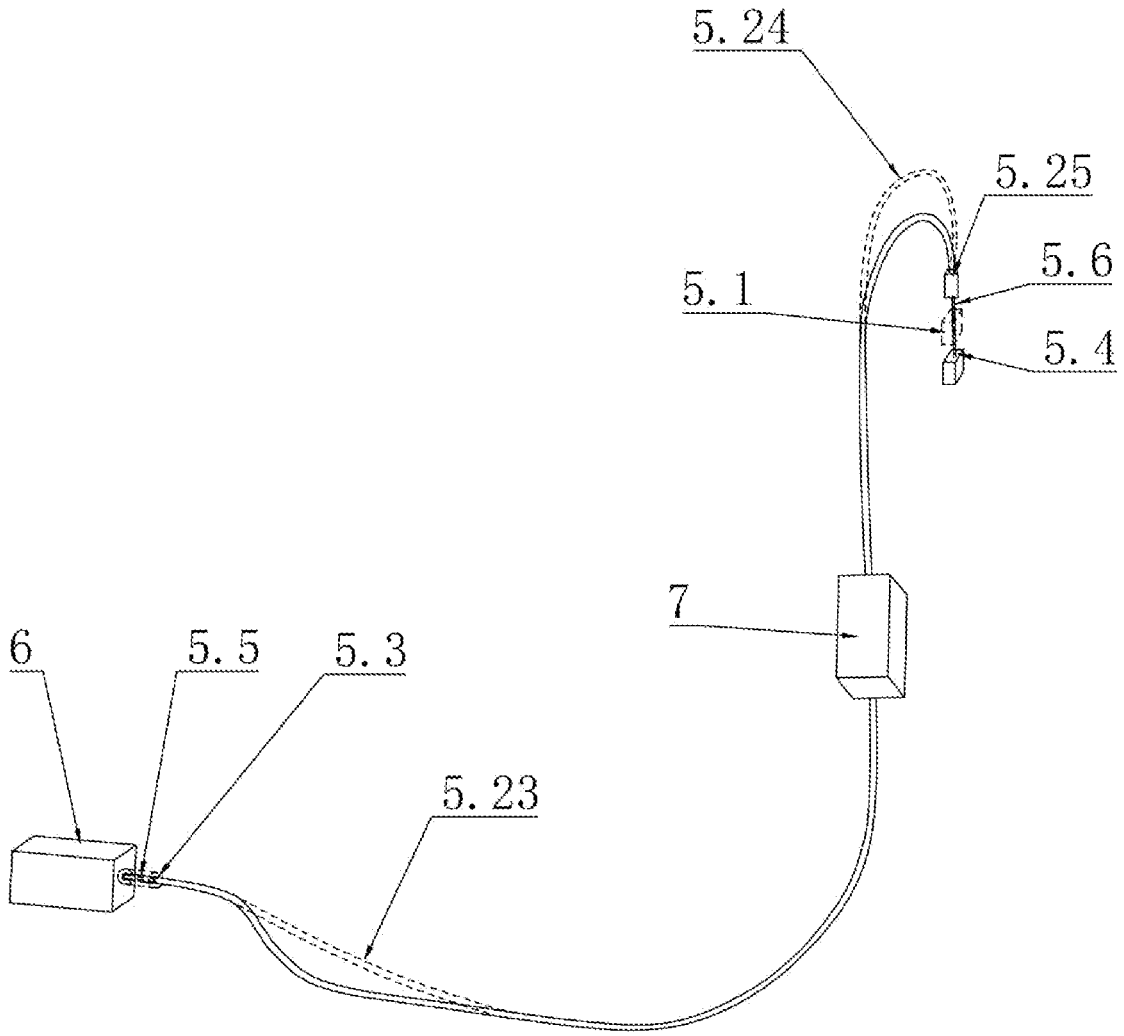
FIG. 15 is a simplified schematic view of the stretching section and lifting section of the present disclosure.

As shown in FIG. 15, in this embodiment, the traction rope 5.2 forms a stretching section 5.23 between the installation part 6.1 and the sealing assembly 7, and forms a lifting section 5.24 between the sealing assembly 7 and the valve stem 2.2. The stretching section 5.23 and the lifting section 5.24 are both arranged in a curved manner. The first control end 5.3 is formed on the stretching section 5.23 to receive the squeeze from the foot-controlled part 6.2, and the second control end 5.4 is formed on the lifting section 5.24 to obtain the squeeze of the stretching section 5.23 and lift (arch) upward, thus driving the lifting block 5.1 upward.

By housing the installation part 6.1 of the foot-controlled assembly 6 in the body 1, extending the operated foot-controlled part 6.2 outside the body 1, and placing the traction rope inside the body 1 and the water tank 1.1, it realize the space optimization of the foot-controlled flushing device, facilitating area planning in different scenarios.

As a further explanation of the traction rope 5.2, the traction rope 5.2 includes a casing 5.21 and a pull wire 5.22 located in the casing 5.21. One end of the casing 5.21 serves as a fixed end and is fixed to the valve body 2.1. The first control end 5.3 is formed on the other end of the casing 5.21 and connected to the foot-controlled part 6.2, one end of the pull wire 5.22 serves as a fixed end and is fixed to the installation part 6.1, and the second control end 5.4 is formed on the other end of the pull wire 5.22 and connected to the lifting block 5.1.

Figure 10:
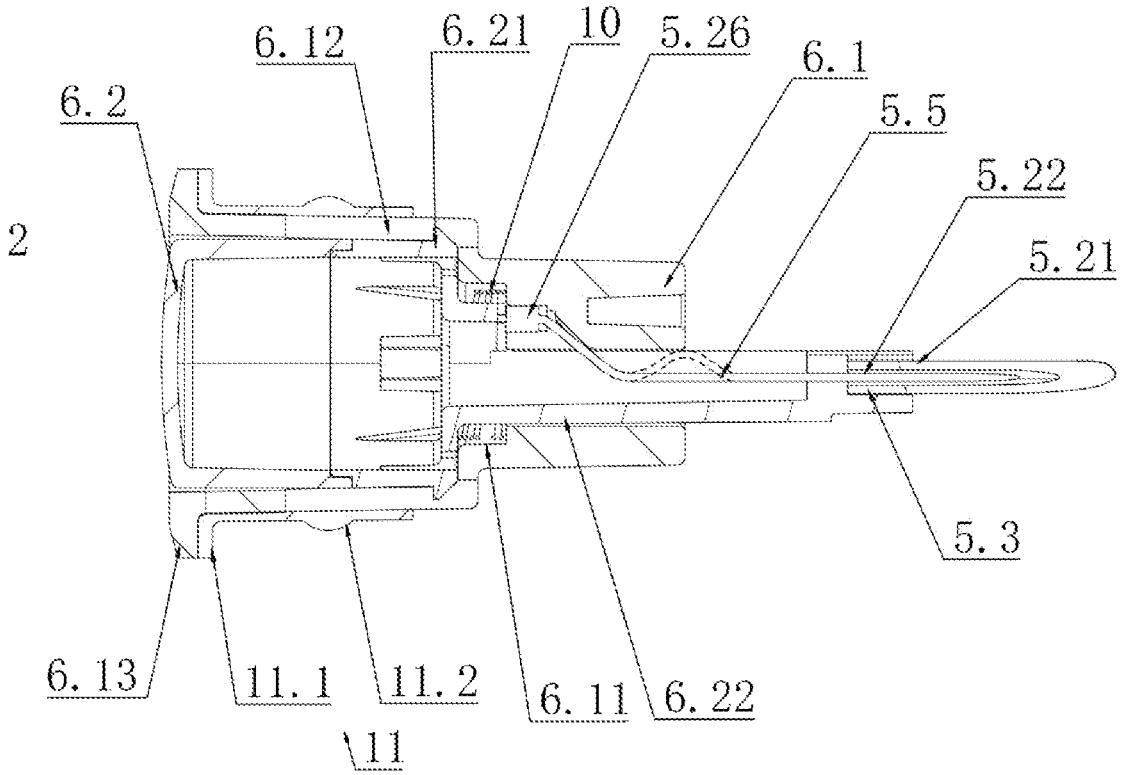
FIG. 10 is a cross-sectional view of the kick-type foot-controlled assembly of the present disclosure in an open state.
Figure 13:
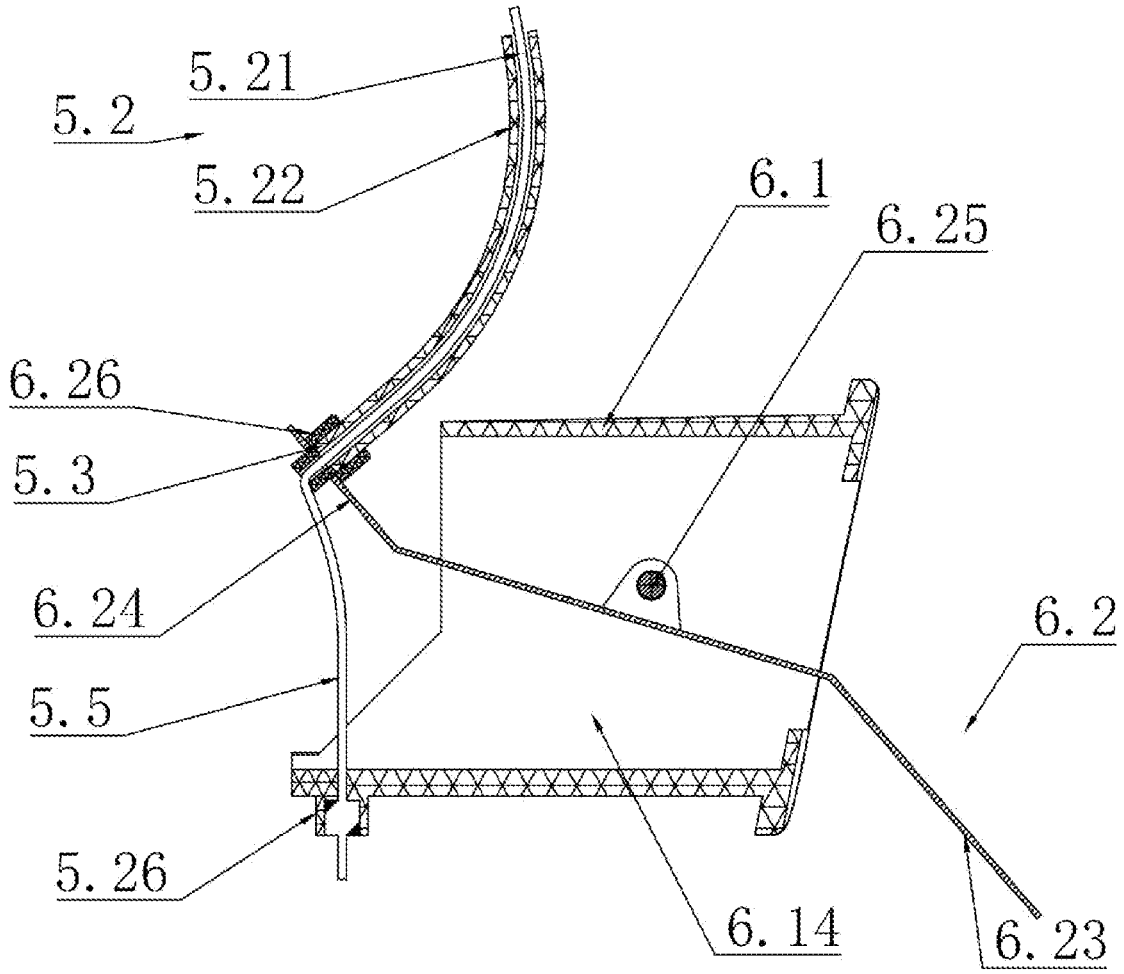
FIG. 13 is a cross-sectional view of the step-on type foot-controlled assembly of the present disclosure in an open state.

As shown in FIGS. 10 and 13, specifically, a first movable section 5.5 is formed between the first control end 5.3 and the pull wire fixed end 5.26, and a second movable section 5.6 is formed between the second control end 5.4 and the casing fixed end 5.25. The first movable section 5.5 and the second movable section 5.6 are arranged in reverse (in inverse proportion), wherein the length of the pull wire 5.22 is longer than that of the casing 5.21, and the lifting stroke (distance) of the lifting block 5.1 matches the difference in length between the casing 5.21 and the pull wire 5.22. The length change caused by the action of the lifting block 5.1 can be bent and released in the above-mentioned first movable section 5.5 and second movable section 5.6.

Herein, the stretching section 5.23 is inserted into the water tank 1.1 in a bottom-up manner, and the lifting section 5.24 extends from the sealing assembly 7 to the top of the valve assembly 2, and is connected to the valve stem 2.2 in a top-down manner, so that the pull wire 5.22 and the casing 5.21 in the water tank 1.1 are U-shaped, or in a U-shaped curved state.

Figure 2:
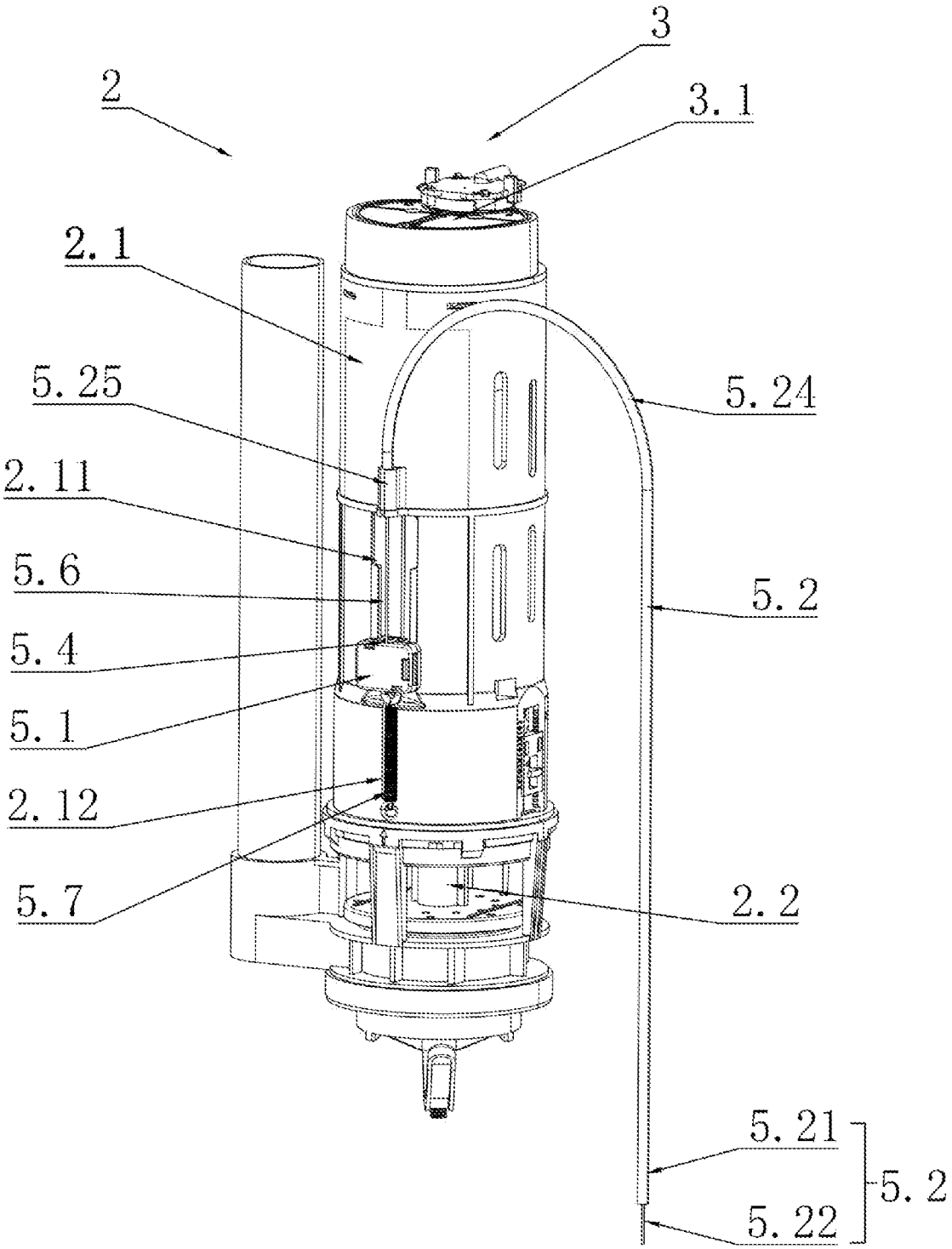
FIG. 2 is a schematic structural view of the valve assembly of the present disclosure.
Figure 3:
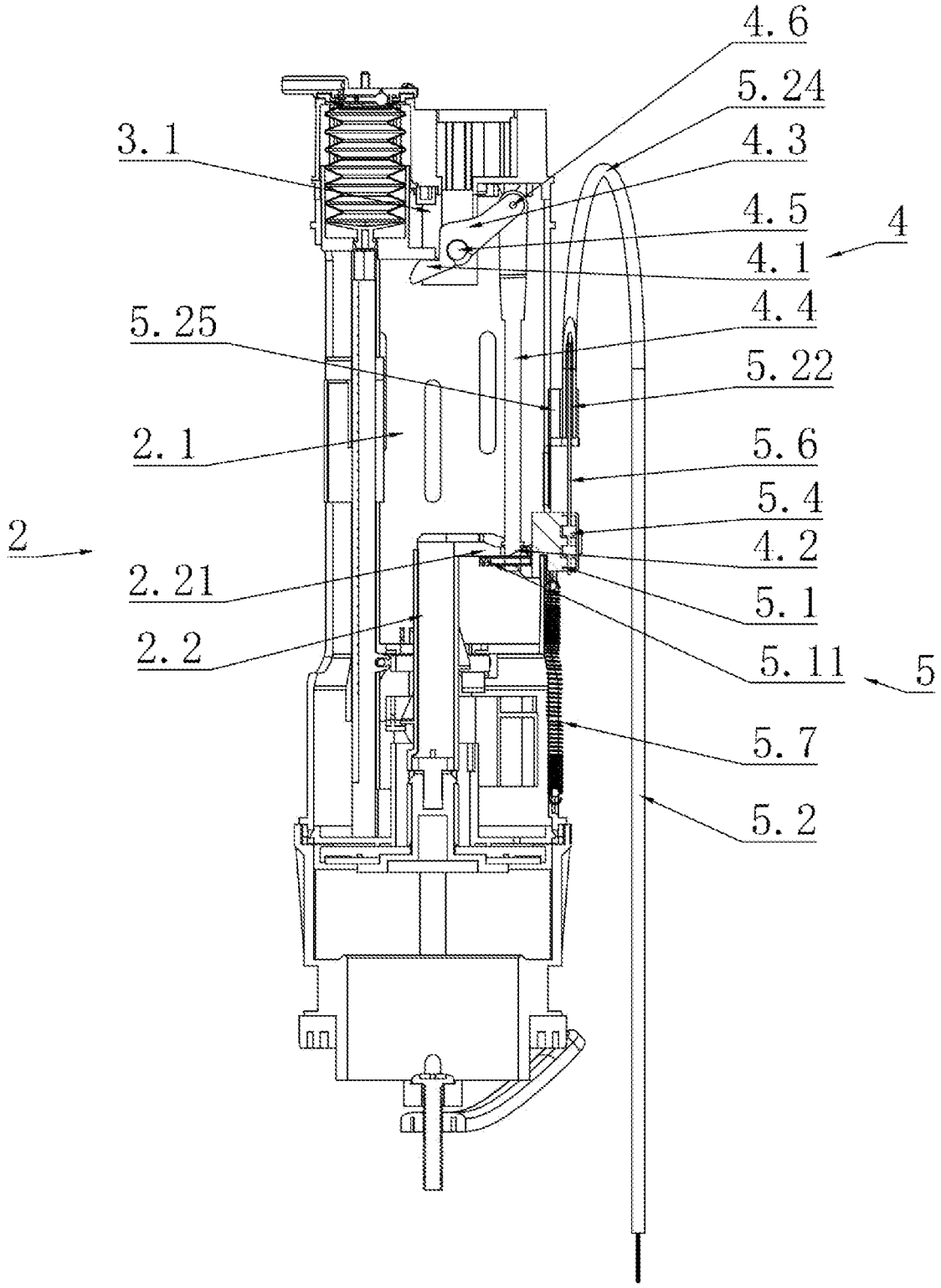
FIG. 3 is a schematic structural view of the valve assembly of the present disclosure in an open state.

As shown in FIGS. 1 to 3, further, in order to return the lifting block 5.1 to the water-closing position after the flushing action is completed, a tension spring 5.7 is provided between the lifting block 5.1 and the valve body 2.1.

As an option, the bottom of the lifting block 5.1 is provided with an upper hook ring for connecting the upper end of the tension spring 5.7, and the valve body 2.1 is provided with a lower hook ring for connecting the lower end of the tension spring 5.7.

As an option, the valve body 2.1 is further provided with an installation slot 2.12 in which the tension spring 5.7 is arranged, so that under any vertical position of the lifting block 5.1, the tension spring 5.7 has a portion accommodated in the installation slot 2.12, thereby ensuring the stability of the return force of lifting block 5.1.

Working Principle of the Second Flushing Mechanism 5:

Under normal conditions, the valve stem 2.2 is located in a relatively lower position of the valve body 2.1, so that the valve stem 2.2 closes the flushing port, the second control end 5.4 is far away from the fixed end of the casing 5.21, at this time, the second movable section 5.6 has the maximum length, the first control end 5.3 is close to the fixed end of the pull wire 5.22, at this time, the first movable section 5.5 has the minimum length.

During Operation:

For the traction rope 5.2, the stretching section 5.23 is squeezed towards the lifting section 5.24 under the action of the foot-controlled part 6.2, part of the casing 5.21 enters the water tank 1.1 under the action of the squeezing (extruding) force, and the lifting section 5.24 has an upward trend after obtaining the extrusion length;

For the casing 5.21, since the fixed end of the casing 5.21 is fixed on the valve body 2.1, the lifting section 5.24 is forced to lift/arch, so that both sides of the curved position on the lifting section 5.24 have a straightening tendency;

For the pull wire 5.22, since the fixed end of the pull wire 5.22 is fixed on the installation part 6.1, the second control end 5.4 obtains an upward straightening force under the arching tendency of the casing 5.21, thereby driving the valve stem 2.2 to lift through the lifting block 5.1, to realize the opening of the flushing port.

At this time, the valve stem 2.2 is lifted by the pull wire 5.22 under the above action, so that the valve stem 2.2 is close to the fixed end of the casing 5.21 to reduce the length of the second movable section 5.6, and the first control end 5.3 moves away from the fixed end of the pull wire 5.22 under the action of the foot-controlled part 6.2, and the length of the first movable section 5.5 increases with the movement of the casing 5.21, so that the pull wire 5.22 can be released in the first movable section 5.5, thereby obtaining a curved space, it realizes the curving of the pull wire 5.22 in the first movable section 5.5 away from the valve stem 2.2 and drives the valve stem 2.2 away from the flushing port.

During the Reset Process:

The lifting block 5.1 returns downward under the action of the tension spring 5.7, and the second control end 5.4 descends with the valve stem 2.2;

For the traction rope 5.2, the arched part of the lifting section 5.24 is released and falls during the operation, while the casing 5.21 is fixed at the fixed end on the lifting section 5.24, and the fixed end of the pull wire 5.22 is fixed at the installation part 6.1, forcing the free end of the casing 5.21 on the stretch section 5.23 to be relaxed.

For the casing 5.21 and the pull wire 5.22, the valve stem 2.2 moves away from the fixed end of the casing 5.21 to increase the length of the second movable section 5.6. At this time, the first control end 5.3 is forced to move toward the fixed end of the pull wire 5.22 to reduce the length of the second movable section 5.6, it forces the curved/bent part of the pull wire 5.22 on the first movable section 5.5 to be straightened and released on the second movable section 5.6, thereby realizing the return of the foot-controlled assembly 6 and the valve assembly 2.

Figure 7:
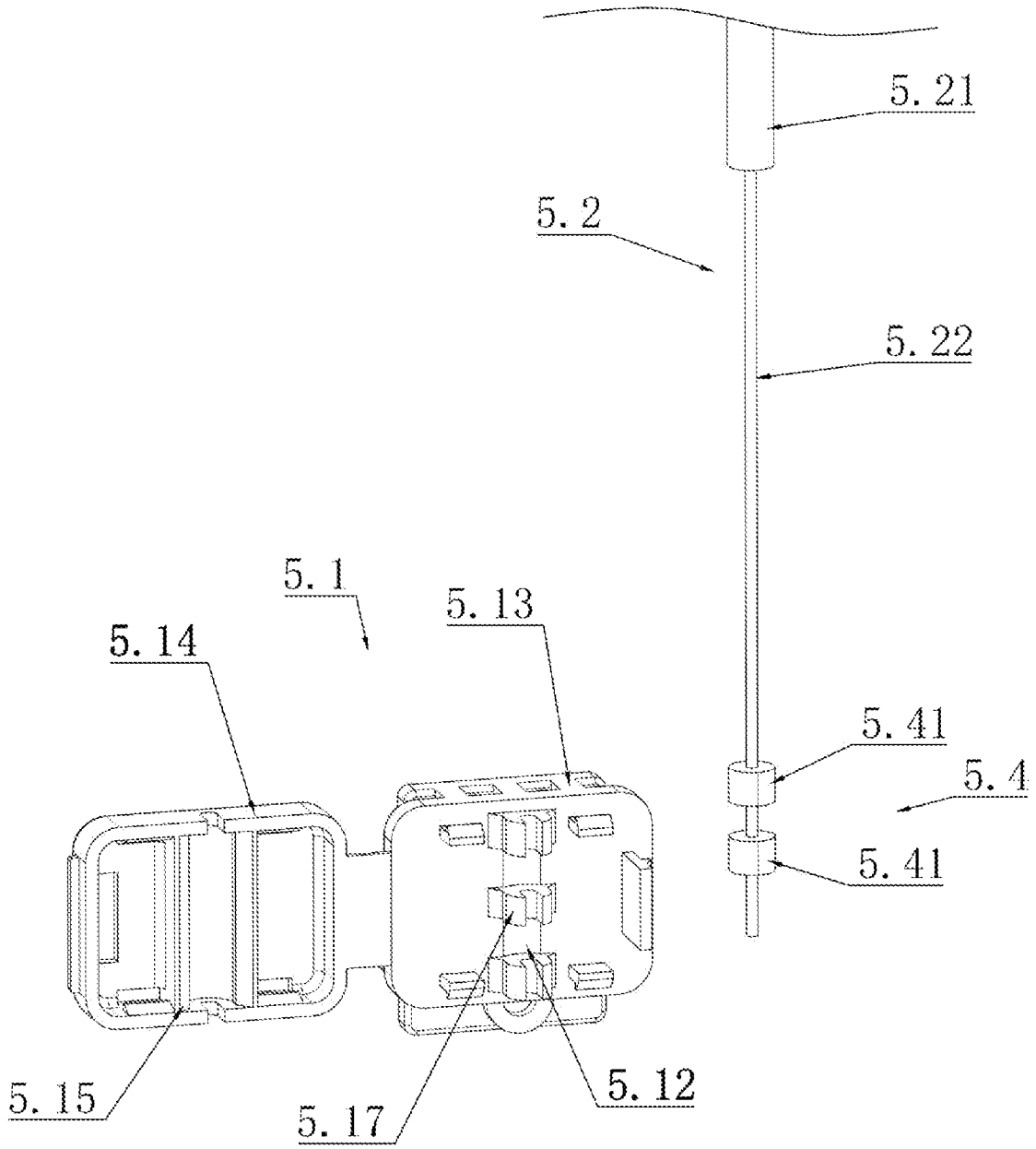
FIG. 7 is an internal schematic view of the lifting block of the present disclosure.

As shown in FIG. 7, in other embodiments, in order to achieve synchronous transmission between the second control end 5.4 and the lifting block, the lifting block 5.1 is provided therein with a cavity 5.12 for defining the current position of the pull wire 5.22. The cavity 5.12 is provided with at least one limiting clamp 5.17, the pull wire 5.22 is arranged in the limiting clamp, and the pull wire 5.22 can adjustably extend outside the cavity 5.12 through the cavity 5.12.

Optionally, a fixed end 5.41 is formed on the second control end, and a wire groove is provided in the limiting clamp for the pull wire to be inserted, and the fixed end abuts against the end surface of the limiting clamp in the lifting direction.

Further, the number of limiting clamps in the cavity is two. The two limiting clamps are arranged in the same direction with respect to the lifting direction, and two fixed ends are formed on the second control end. Through this arrangement, the fixed end is configured to selectively abut against the end surface of one limiting clamp or another limiting clamp, thereby realizing the stroke adjustment of the second control end.

Furthermore, the number of limiting clamps in the cavity is three. The three limiting clamps are arranged in the same direction with respect to the lifting direction, and two fixed ends are formed on the second control end. Through this arrangement, the fixed end 5.41 is configured to selectively abut against the end surface of one limiting clamp or another limiting clamp, thereby increasing the stroke adjustment range of the second control end.

Specifically, the lifting block 5.1 includes a first housing 5.13 and a second housing 5.14 that are interlocked with each other. The second housing 5.14 is provided with raised limiting ribs 5.15, and the limiting ribs 5.15 are arranged in correspondence with the limiting clamps, and there are housing fasteners (hooks) on both sides of the limit clamp. The limit ribs are specifically arranged between the limit clamps and the housing fasteners. When it needs to adjust the second control end 5.4 on the pull wire 5.22, it just needs to open the first housing 5.13 and the second housing 5.14, which is easy to operate.

Herein, the cavity 5.12 is formed in the first housing and the second housing 5.13. The first housing is provided with a sub-cavity matching the contour of the fixed end on one side of the limiting clamps. A through cavity matching the contour of the fixed end is provided in the second housing, and the through cavity also matches the contour of the limiting clamp.

Through the above installation method, the adjustment and installation of the second control end are simplified and the operation is convenient.

As another construction method of the cavity 5.12, the cavity 5.12 is arranged in an annular shape, including an inlet section 5.125 and an outlet section 5.126 linearly arranged with each other, and two petal-shaped bodies 5.121 formed in the cavity 5.12. The two petal-shaped bodies form the limiting clamps, and a limiting corner is formed between the petal-shaped body 5.121 and the cavity 5.12. Among them, a first channel 5.122 is formed between one petal-shaped body 5.121 and the cavity 5.12, a second channel 5.123 is formed between another petal-shaped body 5.121 and the cavity 5.12, and a third channel 5.124 is formed between the two petal-shaped bodies 5.121. The entrance section 5.125 is connected to the first channel 5.122, the first channel 5.122 is connected to the second channel 5.123, the second channel 5.123 is connected to the third channel 5.124, and the third channel 5.124 is connected to the exit section 5.126.

Specifically, the pull wire 5.22 enters the cavity 5.12 from the entrance section 5.125, and is wound around the first channel 5.122, the second channel 5.123 and the third channel 5.124 in sequence, the pull wire 5.22 in the third channel 5.124 is under the pull wire 5.22 in the first and second channels, and is finally wound out from the exit section 5.126 through the third channel 5.124. This method does not require modification of the pull wire, and manual adjustment is simple.

As some ways of driving the foot-controlled part 6.2, the foot-controlled part 6.2 is set to translate for a certain distance (a stroke) horizontally or approximately horizontally relative to the installation part 6.1; or the foot-controlled part 6.2 is set to rotate for an angle relative to the installation part 6.1; or the foot-controlled part 6.2 is set to translate for a certain distance vertically or approximately vertically relative to the installation part 6.1.

Figure 8:
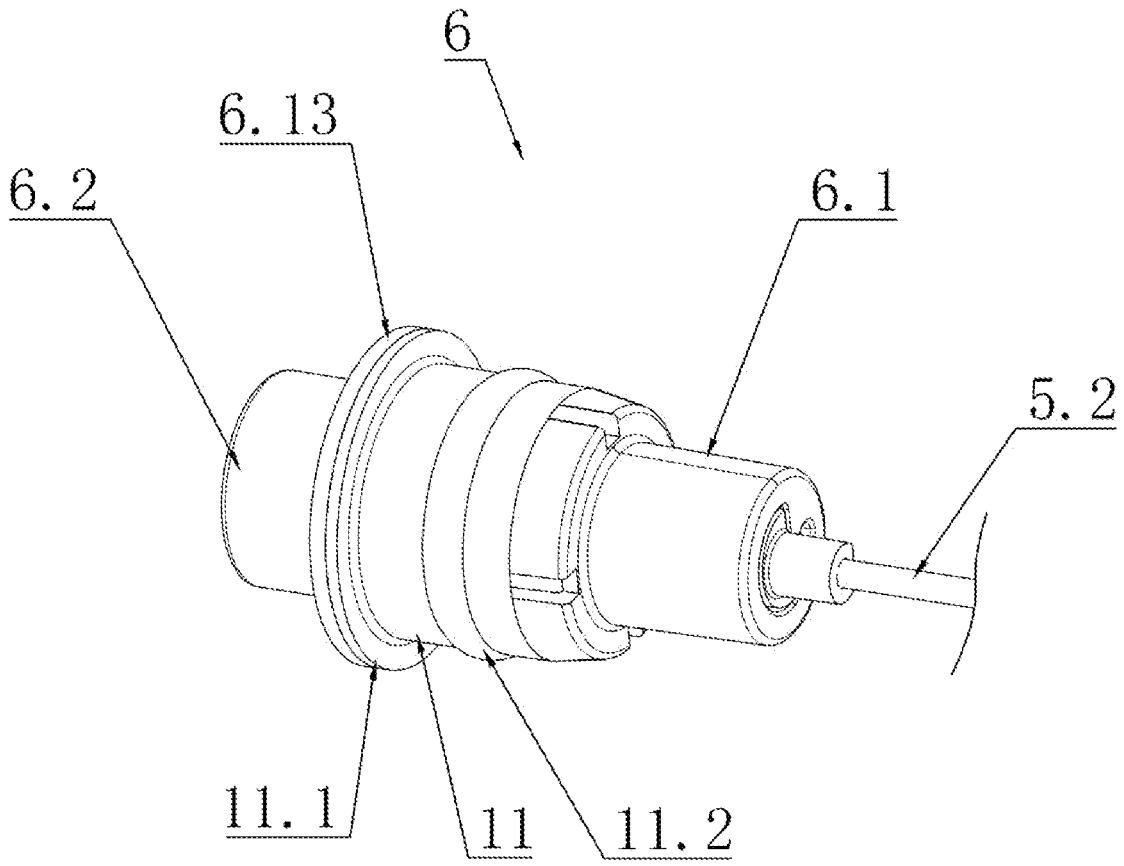
FIG. 8 is a schematic structural view of the kick-type foot-controlled assembly of the present disclosure.
Figure 9:
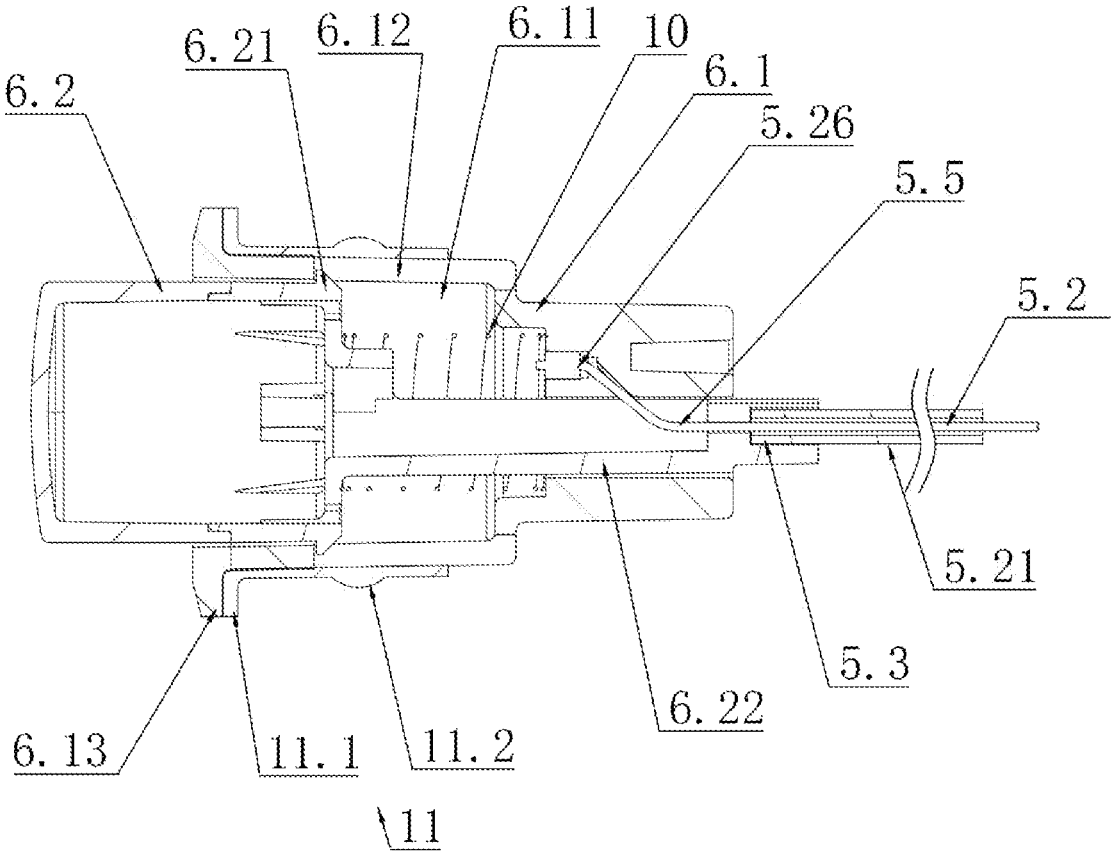
FIG. 9 is a cross-sectional view of the kick-type foot-controlled assembly of the present disclosure in a closed state.

As shown in FIGS. 8 to 10, in other embodiments, the foot-controlled part 6.2 is driven by kicking, and the installation part 6.1 is provided with a movement cavity 6.11 for the foot-controlled part 6.2 to pass through, a second spring 10 is provided in the movement cavity 6.11, the second spring 10 is in contact with and between the foot-controlled part 6.2 and the installation part 6.1, and the second spring 10 gives the foot-controlled part 6.2 a restoring force after flushing.

In this embodiment, the installation part 6.1 is a stepped shaft-shaped base body, and the foot-controlled part 6.2 is a stepped shaft-shaped shaft body. The shaft body at least partially extends outside the base body, and the base body is at least partially installed in the body 1.

Specifically, the foot-controlled part 6.2 is provided with hooks 6.21, and the installation part 6.1 is provided with slideways 4.12 matching the hooks 6.21, wherein the hooks 6.21 and the slideways are arranged in the axial direction, so that the foot-controlled part 6.2 is guided through the hooks 6.21 and the hook grooves.

Specifically, the foot-controlled part 6.2 further includes a first shaft portion passing through the installation part 6.1, and the free end of the casing 5.21 is in contact with and fixed to the end of the first shaft portion. The first shaft portion forms a hole for the pull wire 5.22 to pass through, and a part of the first shaft portion is open, so that the fixed end of the pull wire 5.22 passes through the open side and is wound around and fixed on the installation part 6.1.

Specifically, the installation part 6.1 is provided with a sealing structure. The sealing structure refers to a sealing sleeve 11 set outside the installation part 6.1. The sealing sleeve 11 is in contact with and between the body 1 and the installation part 6.1.

Optionally, the installation part 6.1 includes an installation ring 6.13 extending outside the body 1, and the sealing sleeve 11 has a sealing edge 11.1 that abuts the back of the installation ring 6.13, so that the contour of the sealing sleeve 11 matches the installation part 6.1. In this way, it ensures the tightness of the sealing sleeve 11 and the installation part 6.1 in the assembled state, and improves the sealing between the installation part 6.1 and the body 1.

Optionally, the sealing sleeve 11 is also provided with an annular protrusion 11.2, which presses against the body 1 in the assembled state to further improve the tightness between the sealing sleeve 11 and the body 1.

Figure 11:
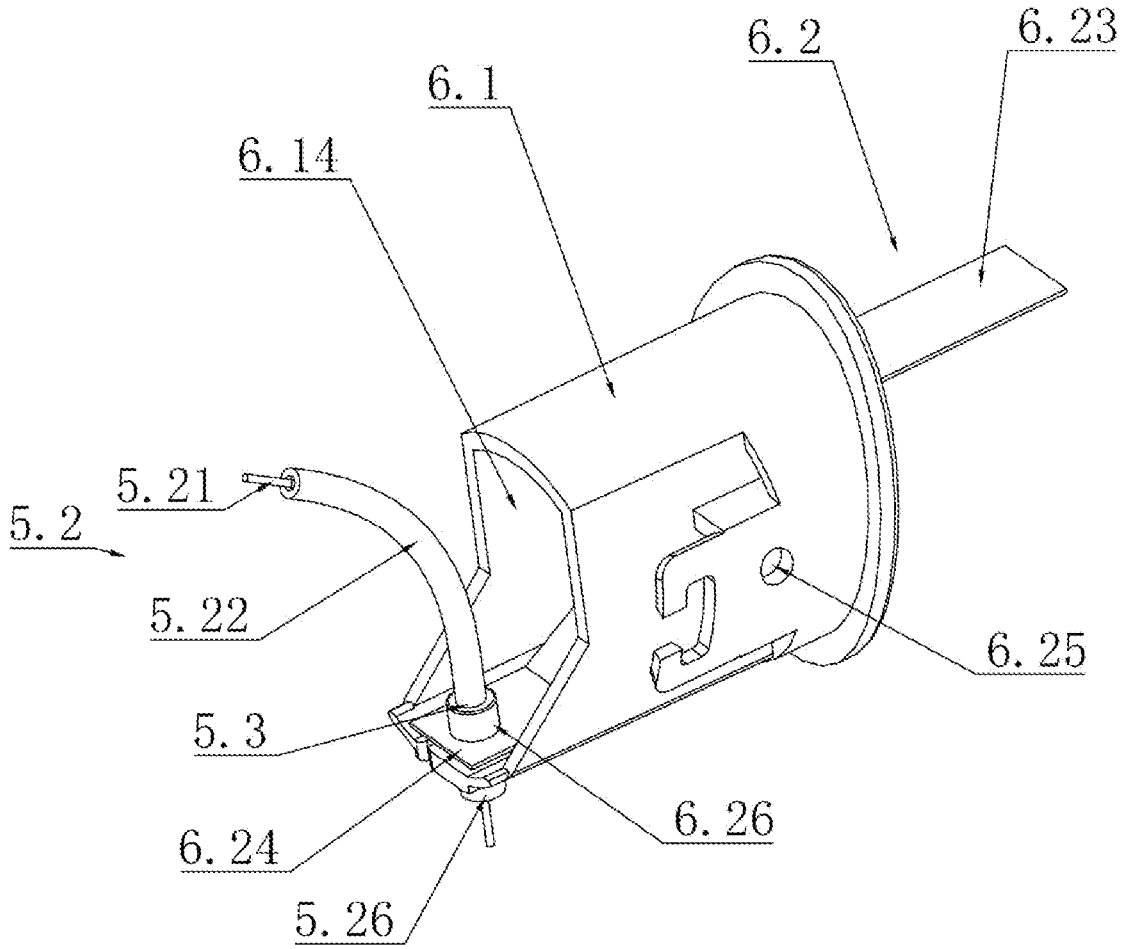
FIG. 11 is a schematic structural view of the step-on type (foot-operated) foot-controlled assembly of the present disclosure.
Figure 12:
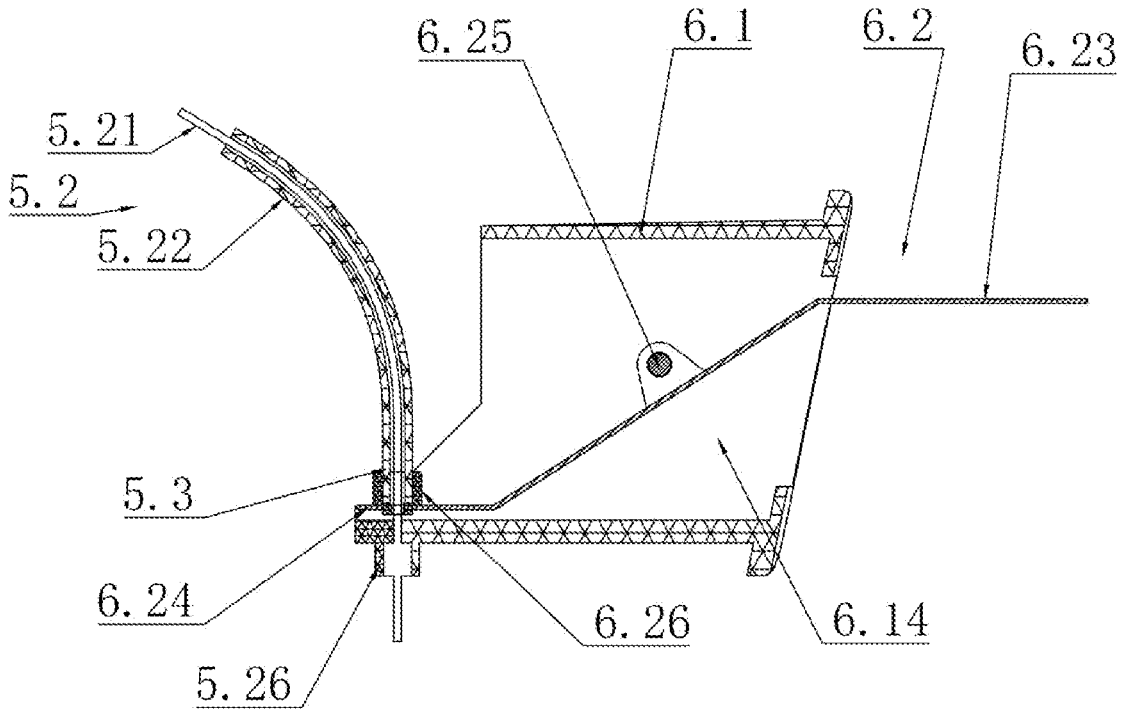
FIG. 12 is a cross-sectional view of the step-on type foot-controlled assembly of the present disclosure in a closed state.

As shown in FIGS. 11 to 13, in other embodiments, the foot-controlled part 6.2 is driven by a foot pedal, and the installation part 6.1 is provided with a rotation cavity 6.14 for the foot-controlled part 6.2 to be rotated and arranged therein, and the pull wire 5.22 passes through the foot-controlled part 6.2, and the foot-controlled part 6.2 is also provided with a plug-in assembly 6.26 fixed to the fixed end of the casing 5.21.

In this embodiment, the installation part 6.1 is in the form of a hollow base body, and the foot-controlled part 6.2 is in the form of a bent piece, which has a foot pedal 6.23 and a transmission plate 6.24. The foot pedal 6.23 and the transmission plate (rotating plate) are arranged approximately parallel, and there is provided a second shaft body 6.25 between the two that matches with the installation part 6.1 in a rotatable way, so that the foot-controlled part 6.2 is rotatably arranged on the installation part 6.1.

Specifically, the transmission plate 6.24 is provided with a fixed ring. The fixed ring faces the side of the casing 5.21 to form a first socket for the casing 5.21 to be inserted and fixed, the fixed ring faces the side of the pull wire 5.22 to form a second socket for the pull wire 5.22 to pass through, and the fixed end of the pull wire 5.22 extends downward to the bottom of the installation part 6.1 and is fixed.

Figure 16:
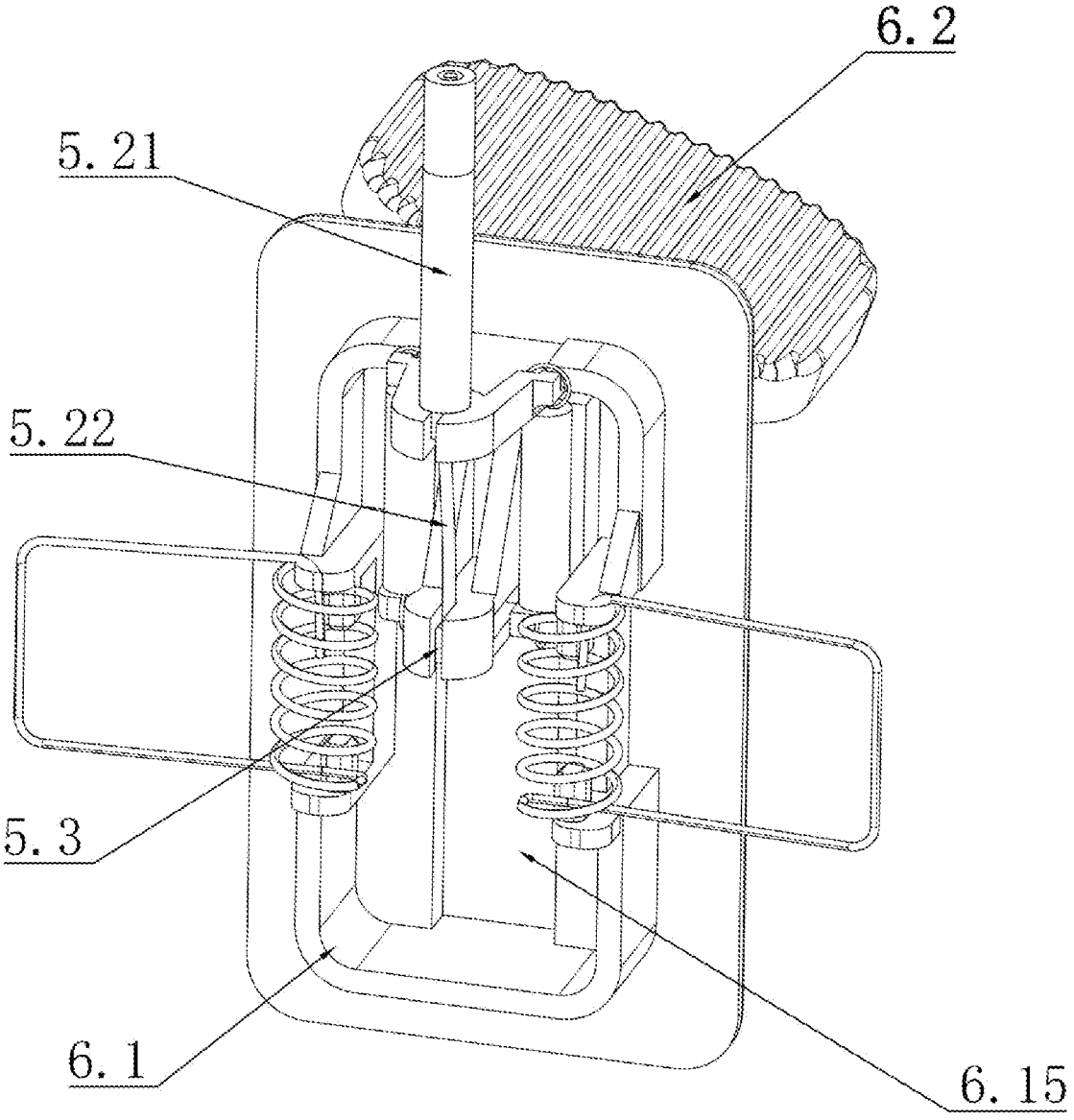
FIG. 16 is a schematic structural view of the step-on type foot-controlled assembly of the present disclosure.
Figure 17:
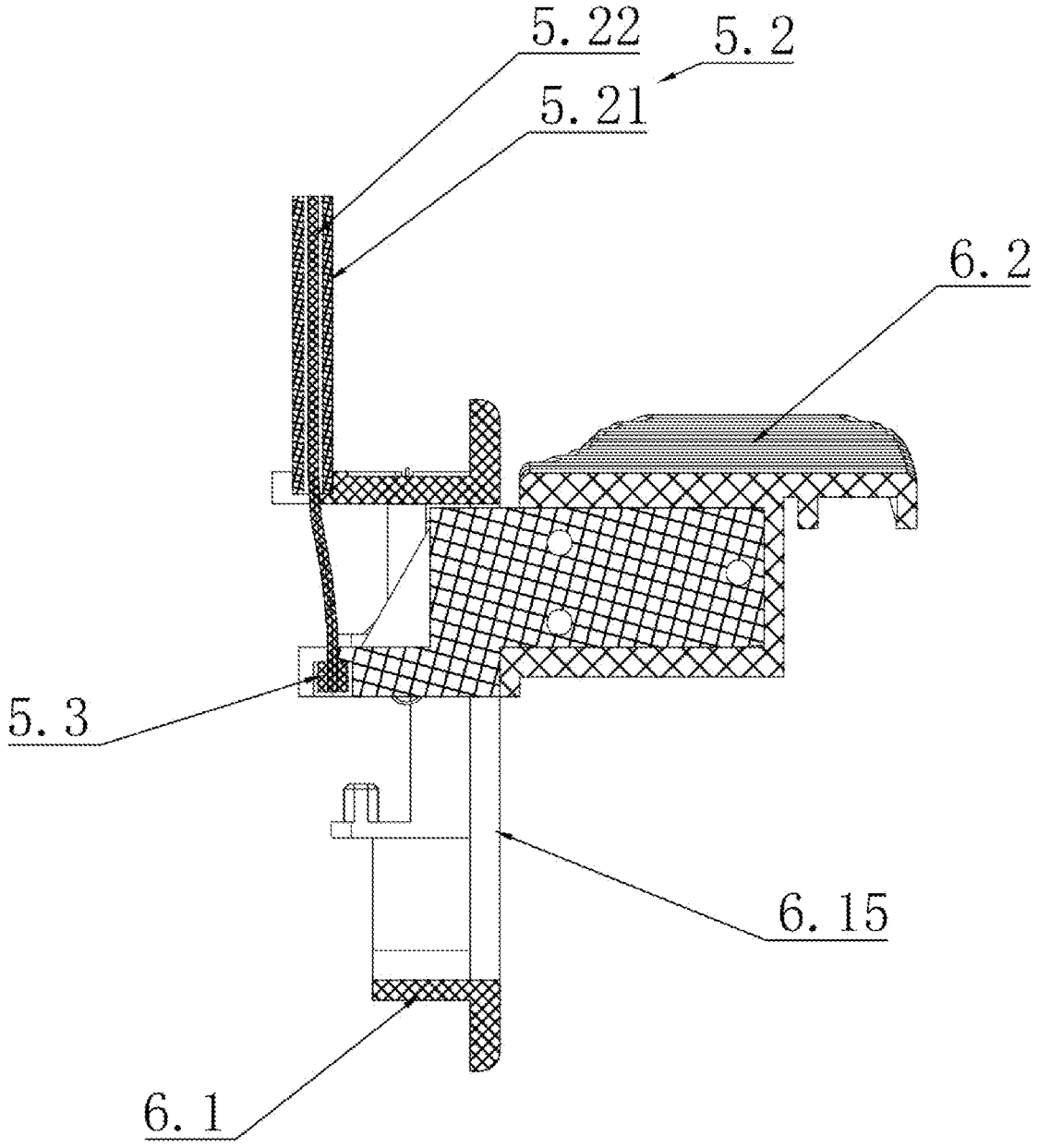
FIG. 17 is a cross-sectional view of the step-on type foot-controlled assembly of the present disclosure in a closed state.
Figure 18:
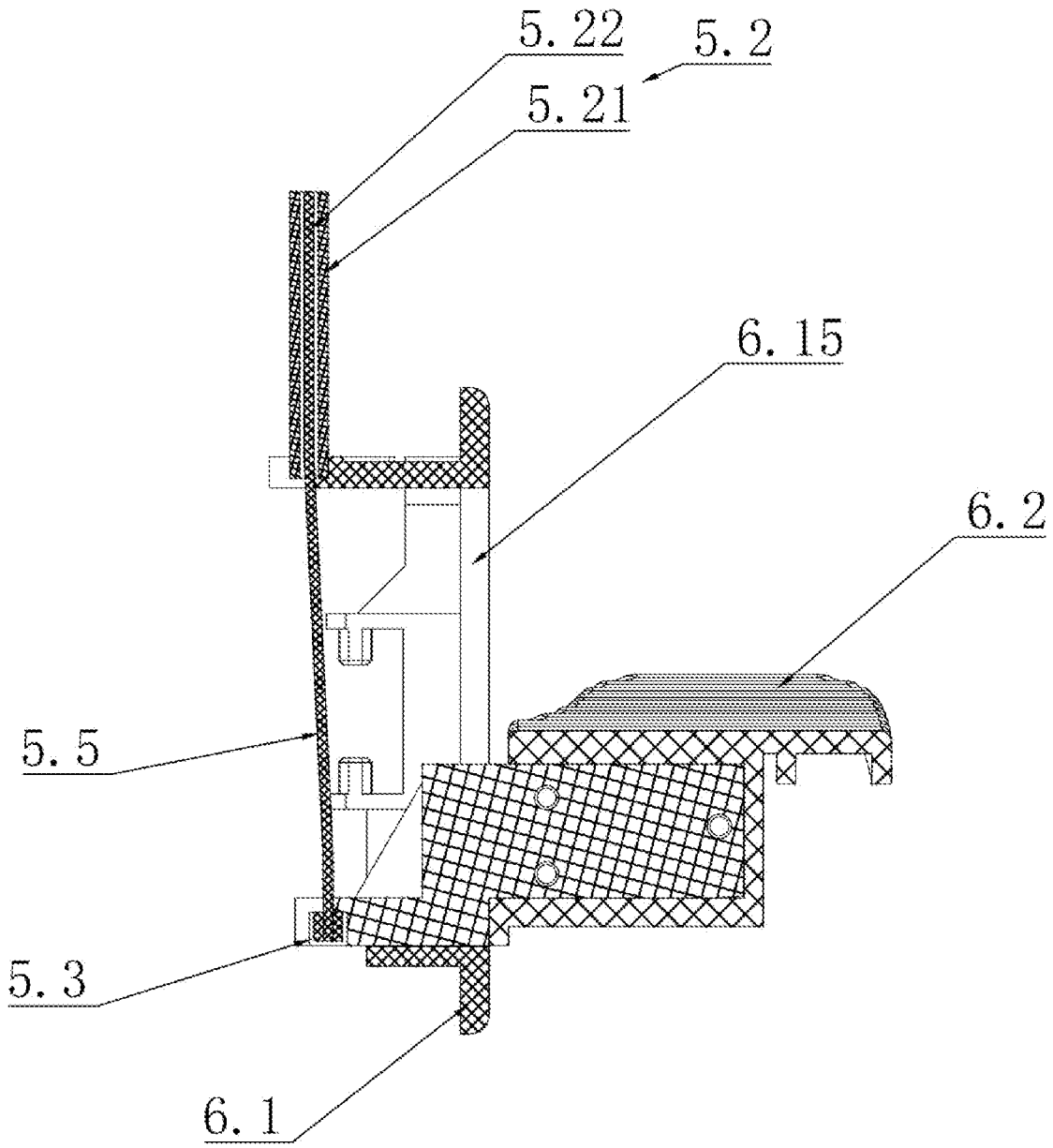
FIG. 18 is a cross-sectional view of the step-on type foot-controlled assembly of the present disclosure in an open state.

As shown in FIGS. 16 to 18, as another embodiment in which the foot-controlled part 6.2 is driven in the form of a foot pedal, the installation part 6.1 is provided with a vertically arranged channel 6.15, the foot-controlled part 6.2 is inserted into the channel, and the installation part 6.1 is provided with a hole for fixing the casing 5.21, and the foot-controlled part 6.2 is provided with a hole for fixing the pull wire 5.22. In this embodiment, the foot-controlled part 6.2 is operated from top to bottom, so that the pull wire 5.22 is directly pulled to drive the lifting block and the valve stem upward.

Specifically, the foot-controlled part 6.2 is arranged in the form of a pedal, and the pedal forms an inclination angle with respect to the ground to adapt to ergonomics.

In other embodiments, in order to facilitate the convenient installation of the foot-controlled mechanism, the installation part 6.1 is provided with a mounting bracket inserted into the body 1, and a torsion spring 12 is provided rotatably on the mounting bracket. The torsion spring 12 enters the body 1 with the mounting bracket and restricts the installation part 6.1 from coming out. Through the above improvements, the installation of the foot-controlled mechanism is simplified. You only need to close the torsion spring 12 on the installation part 6.1, and then insert it into the body 1. The torsion spring 12 opens to both sides under the action of its elastic force, thereby realizing the fixation of the foot-controlled mechanism.

Figure 14:
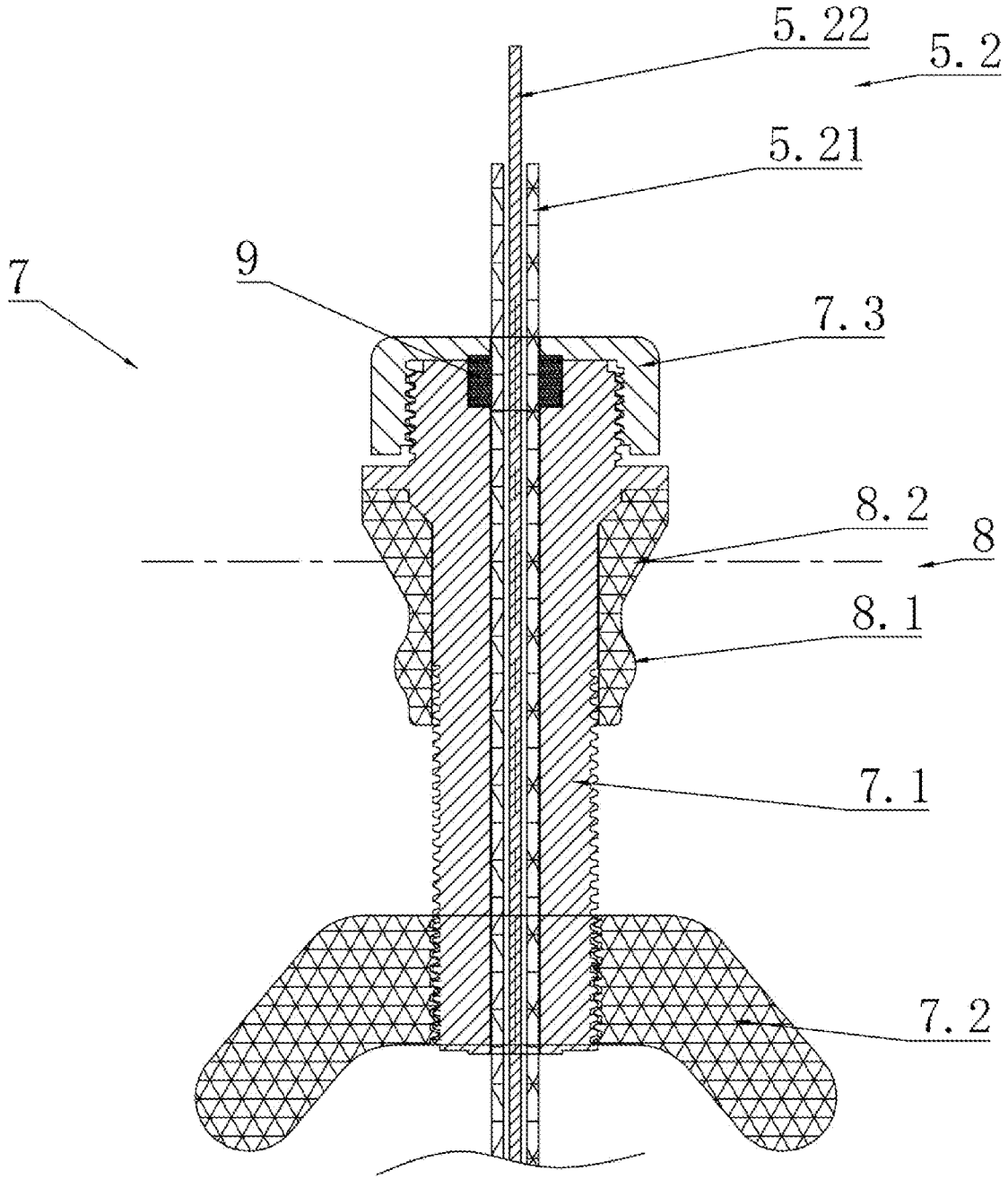
FIG. 14 is a cross-sectional view of the sealing assembly of the present disclosure.

As shown in FIG. 14, as a further explanation of the sealing assembly 7, the sealing assembly 7 is provided between the water tank 1.1 and the traction rope 5.2. The sealing assembly 7 includes:

- a first connecting piece 7.1, a first sealing piece 8 being provided between the first connecting piece 7.1 and the water tank 1.1, and a second sealing piece 9 being provided between the first connecting piece 7.1 and the casing 5.21;
- a second connecting piece 7.2 screwed on one end of the first connecting piece 7.1 and configured to tightly pull the first connecting piece 7.1, so that the first sealing piece 8 fits tightly between the first connecting piece 7.1 and the water tank 1.1;
- a third connecting piece 7.3 screwed on the other end of the first connecting piece 7.1 and configured to press the second sealing piece 9 between the first connecting piece 7.1 and the casing 5.21.

Herein, the first connecting piece 7.1 in this embodiment can be a waterproof bolt with a middle hole, the second connecting piece 7.2 can be a waterproof nut cover, and the third connecting piece 7.3 can be a lock nut.

As a further embodiment of the first sealing piece 8, the first sealing piece 8 is sleeved on the first connecting piece 7.1, and the first sealing piece 8 includes a first sealing section and a second sealing section. The first sealing section is fully matched with the water tank 1.1, and the second sealing section is partially matched with the water tank 1.1. The first sealing section is provided with a sealing ring-shaped protrusion 8.1 that forms an extrusion seal with the water tank 1.1, and the second sealing section is provided with a cone 8.2 that forms an extrusion seal with the water tank 1.1. The small end of the cone 8.2 is connected to the first sealing section, the large end of the cone 8.2 is set close to the water tank 1.1, the inner cavity boundary of the water tank 1.1 is pressed against the cone 8.2, the cavity boundary of the water tank 1.1 is forced to squeeze with the cone 8.2 by the thread tightening effect of the third connecting piece 7.3, thereby adjusting the sealing performance of the water tank 1.1 through the third connecting piece 7.3. At the same time, the axis stability of the sealing assembly 7 at the installation position is increased through the guidance of the cone 8.2, to ensure the sealing effect.

As a further embodiment of the second sealing piece 9, a socket is provided at the top of the first connecting piece 7.1 for receiving the second sealing piece 9. The second sealing piece 9 is a sealing plug with a continuous outer diameter. The cross-section of the socket is tapered, and the bottom of the socket corresponds to the smallest end, and the second sealing piece 9 forces the casing 5.21 to form a seal structure with the first connecting piece 7.1 through the thread compression of the second connecting piece 7.2.

These specific embodiments are only an explanation of the present disclosure, but not a limitation of the present disclosure. Modifications to these embodiments may be made as needed by those skilled in the art without creative contribution after reading the present disclosure. However, as long as they fall within the scope of the claims of the present disclosure, they would be protected by patent law.

What is claimed is:

1. A dual-control flushing device, comprising:

a body (1), provided with a water tank (1.1) therein, wherein a flushing port is connected to the water tank (1.1);

a valve assembly (2) provided in the water tank (1.1) and comprising a valve body (2.1) and a valve stem (2.2) provided in the valve body (2.1), wherein the valve stem (2.2) is configured for controlling opening or closing of the flushing port, a transmission part (2.21) extends from an end of the valve stem (2.2);

a first flushing mechanism (3) comprising a pressing assembly (3.1) and a transmission assembly (4) placed in the valve body (2.1), wherein the transmission assembly (4) comprises a first transmission end (4.1) coupled with the pressing assembly (3.1) and a second transmission end (4.2) coupled with the transmission part (2.21), a hinge part is provided between the first transmission end (4.1) and the second transmission end (4.2), the second transmission end (4.2) moves and drives the valve stem (2.2) to lift as the pressing assembly is pressed;

a second flushing mechanism (5) comprising a foot-controlled assembly (6), a lifting block (5.1) and a traction rope (5.2) placed outside the valve body (2.1), wherein the lifting block (5.1) comprises a lifting part (5.11) extending into the valve body (2.1), the lifting part (5.11) holds a bottom of the transmission part (2.21), the traction rope (5.2) comprises a first control end (5.3) connected to the foot-controlled assembly (6) and a second control end (5.4) connected to the lifting block (5.1), the foot-controlled assembly (6) is configured to squeeze or release the first control end (5.3), so that the first control end (5.3) and the second control end (5.4) move and drive the lifting block (5.1) and the valve stem (2.2) to lift synchronously;

wherein the transmission assembly (4) comprises a first connecting rod (4.3) rotatably arranged on an upper part of the valve body (2.1) and a second connecting rod (4.4) rotatably connected to the first connecting rod (4.3), the first transmission end (4.1) is formed at an end of the first connecting rod (4.3) and connected to the pressing assembly (3.1), the second transmission end (4.2) is formed at a lower end of the second connecting rod (4.4) and connected to the transmission part (2.21).

2. The dual-control flushing device according to claim 1, wherein the foot-controlled assembly (6) comprises an installation part (6.1) placed in the body (1) and a foot-controlled part (6.2) extending out of the body (1);

the traction rope (5.2) comprises a casing (5.21) and a pull wire (5.22) located in the casing (5.21), one end of the casing (5.21) is fixed to the valve body (2.1), the first control end (5.3) is formed on the other end of the casing (5.21) and connected to the foot-controlled part (6.2), one end of the pull wire (5.22) is fixed to the installation part (6.1), and the second control end (5.4) is formed on the other end of the pull wire (5.22) and connected to the lifting block (5.1).

3. The dual-control flushing device according to claim 1, wherein the traction rope (5.2) comprises a stretching section (5.23) arranged between the body (1) and the water tank (1.1), and a lifting section (5.24) arranged in the water tank (1.1), the stretching section (5.23) and the lifting section (5.24) are both arranged in a curved manner.

4. The dual-control flushing device according to claim 2, wherein a first movable section (5.5) is formed between the first control end (5.3) and a fixed end of the pull wire (5.22), a second movable section (5.6) is formed between the second control end (5.4) and a fixed end of the casing (5.21), and the first movable section (5.5) and the second movable section (5.6) are arranged in reverse.

5. The dual-control flushing device according to claim 2, wherein the lifting block (5.1) is provided with a cavity (5.12) for limiting a current position of the pull wire (5.22), at least one limiting clamp (5.17) is provided in the cavity (5.12), the pull wire (5.22) is clamped in the limiting clamp (5.17), and the pull wire (5.22) is adjustably provided inside the cavity (5.12).

6. The dual-control flushing device according to claim 5, wherein the lifting block (5.1) comprises a first housing (5.13) and a second housing (5.14) interlocked with each other, the cavity is further provided therein with a limiting rib (5.15) corresponding to the limiting clamp (5.17).

7. The dual-control flushing device according to claim 1, wherein the foot-controlled assembly (6) comprises an installation part (6.1) placed in the body (1) and a foot-controlled part (6.2) extending out of the body (1);

the foot-controlled part (6.2) is configured to be capable of translating for a certain distance horizontally or approximately horizontally relative to the installation part (6.1); or the foot-controlled part (6.2) is configured to be capable of rotating for an angle relative to the installation part (6.1); or the foot-controlled part (6.2) is configured to be capable of translating for a certain distance vertically or approximately vertically relative to the installation part (6.1).

8. The dual-control flushing device according to claim 7, wherein the installation part (6.1) is provided with a mounting bracket inserted into the body (1), a torsion spring (12) is provided on the mounting bracket, the torsion spring (12) enters the body (1) with the mounting bracket and restricts the installation part (6.1) from coming out.

9. The dual-control flushing device according to claim 1, wherein a sealing assembly (7) is provided between the water tank (1.1) and the traction rope (5.2), and the sealing assembly (7) comprises:

a first connecting piece (7.1), a first sealing piece (8) being provided between the first connecting piece (7.1) and the water tank (1.1), and a second sealing piece (9) being provided between the first connecting piece (7.1) and the casing (5.21);

a second connecting piece (7.2) screwed on one end of the first connecting piece (7.1) and configured to tightly pull the first connecting piece (7.1), so that the first sealing piece (8) fits tightly between the first connecting piece (7.1) and the water tank (1.1);

a third connecting piece (7.3) screwed on the other end of the first connecting piece (7.1) and configured to press the second sealing piece (9) between the first connecting piece (7.1) and the casing (5.21).

* * * * *